US011228111B2

(12) United States Patent
Liu et al.

(10) Patent No.: US 11,228,111 B2
(45) Date of Patent: Jan. 18, 2022

(54) COMPACT DIPOLE ANTENNA DESIGN

(71) Applicant: International Business Machines Corporation, Armonk, NY (US)

(72) Inventors: Duixian Liu, Scarsdale, NY (US); Arun Paidimarri, White Plains, NY (US); Bodhisatwa Sadhu, Peekskill, NY (US); Alberto Valdes Garcia, Chappaqua, NY (US)

(73) Assignee: International Business Machines Corporation, Armonk, NY (US)

( * ) Notice: Subject to any disclaimer, the term of this patent is extended or adjusted under 35 U.S.C. 154(b) by 19 days.

(21) Appl. No.: 16/381,528

(22) Filed: Apr. 11, 2019

(65) Prior Publication Data

US 2020/0328522 A1 Oct. 15, 2020

(51) Int. Cl.

| | |
|---|---|
| ***H01Q 9/28*** | (2006.01) |
| ***H01Q 1/36*** | (2006.01) |
| ***H01Q 9/40*** | (2006.01) |
| ***H01Q 9/04*** | (2006.01) |

(52) U.S. Cl.

CPC ..... *H01Q 9/285* (2013.01); *H01Q 1/36* (2013.01); *H01Q 9/0407* (2013.01); *H01Q 9/40* (2013.01)

(58) Field of Classification Search

CPC ..... H01Q 9/285; H01Q 1/36; H01Q 9/0407; H01Q 9/40

USPC ..... 343/703, 745, 843

See application file for complete search history.

(56) References Cited

U.S. PATENT DOCUMENTS

| | | | | |
|---|---|---|---|---|
| 6,373,447 | B1 | 4/2002 | Rostoker et al. | |
| 6,424,311 | B1 | 7/2002 | Tsai et al. | |
| 6,573,874 | B1 * | 6/2003 | Saito | H01Q 3/247 343/733 |
| 7,541,999 | B2 * | 6/2009 | Matsushita | H01P 1/161 343/770 |
| 8,193,873 | B2 * | 6/2012 | Kato | H01Q 7/00 333/24 R |
| 10,135,138 | B2 | 11/2018 | Puente Baliarda et al. | |
| 2005/0001777 | A1 | 1/2005 | Suganthan et al. | |
| 2009/0262041 | A1 * | 10/2009 | Ikemoto | H01Q 1/40 343/860 |

(Continued)

FOREIGN PATENT DOCUMENTS

| | | | |
|---|---|---|---|
| EP | 2940794 | A1 | 11/2015 |
| WO | 2015/062030 | A1 | 5/2015 |

OTHER PUBLICATIONS

Yang, J., et al., "Design of Miniaturized Dual-Band Microstrip Antenna for WLAN Application", Sensors 2016, https://www.mdpi.com/1424-8220/16/7/983/pdf, Accessed Apr. 9, 2019, pp. 1-15.

(Continued)

*Primary Examiner* — Wei (Victor) Y Chan

(74) *Attorney, Agent, or Firm* — Scully, Scott, Murphy & Presser, P.C.; Daniel P. Morris

(57) ABSTRACT

An antenna that can be embedded in a computer system or device is described. In an example, the antenna includes a feed operable to transmit and receive power. The antenna includes a first arm being extended from the feed towards a first direction to form a first partial loop. The antenna further includes a second arm being extended from the feed towards a second direction to form a second partial loop. The second direction is different from the first direction.

6 Claims, 6 Drawing Sheets

(56) References Cited

U.S. PATENT DOCUMENTS

| | | | |
|---|---|---|---|
| 2017/0365926 | A1 | 12/2017 | Kishimoto et al. |
| 2018/0226717 | A1 | 8/2018 | Desclos et al. |

OTHER PUBLICATIONS

Fujimaki, T., et al., "An Electrically Small On-Chip Antenna Scaled down to One-Twentyfifth by One-Fiftieth of Wavelength", AP-S 2018, Jul. 8-13, 2018, pp. 299-300.

Radiom, S., et al., "A Monolithically Integrated On-Chip Antenna in 0.18 μm Standard CMOS Technology for Far-Field Short-Range Wireless Powering," IEEE Antennas and Wireless Propagation Letters, Feb. 2010 pp. 631-633, vol. 9.

Sallam, M.O., et al., "Electrically Small Antennas with Dimensions down to One-Fifteenth and One-Thirtieth of Wavelength," AP-S 2015, Jul. 2015, pp. 1236-1237.

* cited by examiner

COMPACT DIPOLE ANTENNA DESIGN

BACKGROUND

The present application relates generally to antenna design methods and structures. In one aspect, the present application relates more particularly to a compact dipole antenna.

A radio frequency integrated circuit (RFIC) can be configured to operate at a frequency range suitable for wireless transmissions. RFICs can include a computer chip coupled to an antenna, forming wireless transmission systems. The size of the antenna can be designed to accommodate an operating wavelength or operating frequency of the RFIC. For example, a decrease in the operating frequency increases an operating wavelength of the antenna.

SUMMARY

In some examples, an antenna is generally described. The antenna may include a feed operable to transmit and receive power. The antenna may further include a first arm being extended from the feed towards a first direction to form a first partial loop. The antenna may further include a second arm being extended from the feed towards a second direction to form a second partial loop. The second direction is different from the first direction.

In some examples, a system including an integrated circuit and an antenna is generally described. The antenna may be connected to the integrated circuit. The antenna may include a feed operable to transmit and receive power. The antenna may further include a first arm being extended from the feed towards a first direction to form a first partial loop. The antenna may further include a second arm being extended from the feed towards a second direction to form a second partial loop. The second direction is different from the first direction.

In some examples, a method for forming an antenna is generally described. The method may include patterning a first arm of the antenna to extend from a feed of the antenna towards a first direction forming a first partial loop. The method may further include patterning a second arm of the antenna to extend from the feed of the antenna towards a second direction forming a second partial loop. The second direction is opposite from the first direction.

Further features as well as the structure and operation of various embodiments are described in detail below with reference to the accompanying drawings. In the drawings, like reference numbers indicate identical or functionally similar elements.

DETAILED DESCRIPTION

Figure 1:
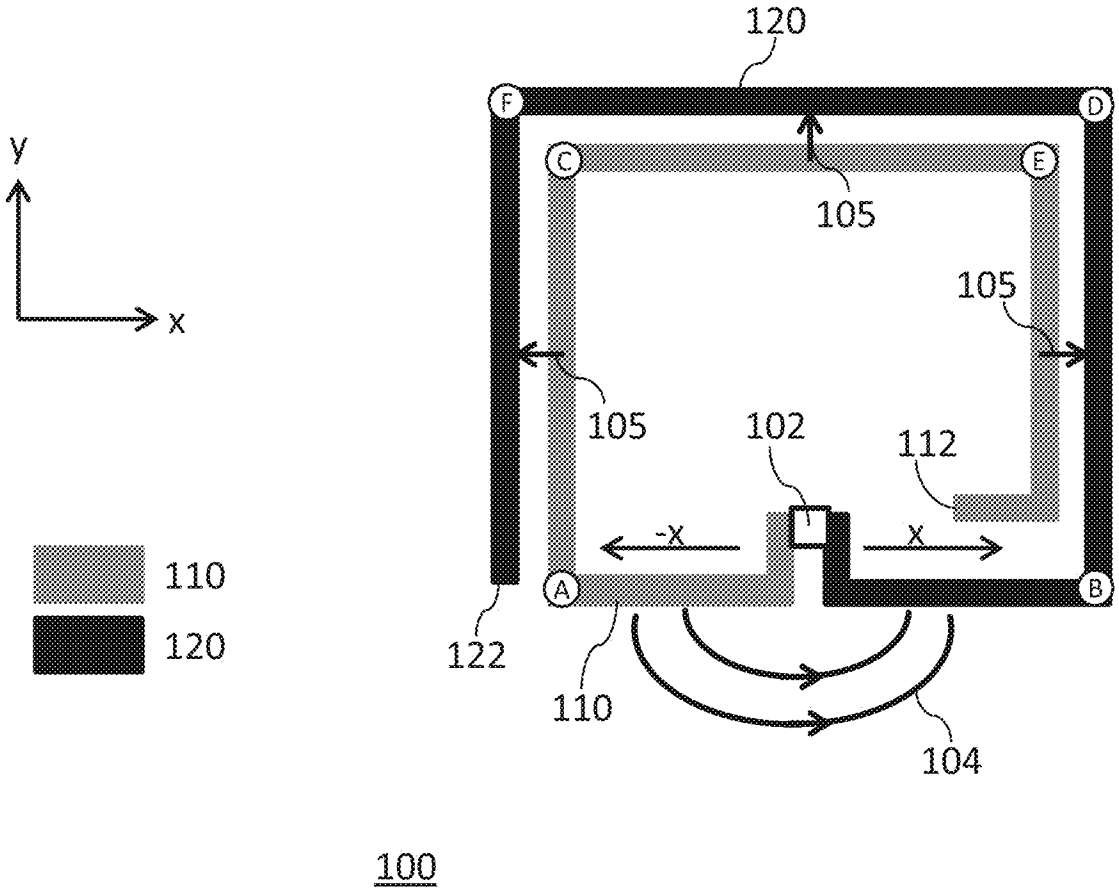
FIG. 1 is a diagram illustrating a compact dipole antenna in one embodiment.

In an example, low frequency RFIC applications may have a relatively long operating wavelength, which may require a relatively large antenna. In some examples, an increase in antenna size may not always be desirable for certain low frequency applications, such as those being physically implemented on compact or miniature devices and wireless transmission systems. In some examples, a decrease in the size of such an antenna can penalize the gain of the antenna. To be described in more detail below, a dipole antenna structure in accordance with the present disclosure can be designed to have a relatively small size yet accommodate the increased wavelength in low frequency applications. In an example, an antenna described in accordance with the present disclosure can achieve a dimension less than 1/25 wavelength and can provide improved gain performance when compared with similar antenna designs.

In an example, radio frequency (RFID) readers and RFID tags may implement dipole antennas to facilitate data and power transmission in RFID applications and systems. A dipole antenna can resonate at a resonant frequency to produce a standing wave, such that the length of the conductors (e.g., the arms) can be sized based on the operating wavelength or frequency of the dipole antenna. For example, a half-wavelength dipole antenna includes two dipole arms, where each dipole arm's length is substantially a quarter of the operating wavelength, causing a total size or length of the half-wavelength dipole antenna to be substantially half the operating wavelength. Therefore, to design a dipole antenna that operates at longer wavelengths, the length of the arms will need to be increased, which may be undesirable for some wireless transmission applications and systems. Further, in some examples, antennas can be designed as resonating antennas to improve their radiation efficiency.

In some example embodiments, an antenna can be designed to conjugate match, as closely as possible, to the circuit's impedance. Thus, the resonant frequency of the antenna can be used as a proxy for operating frequency. An antenna can be designed to be as large as possible (within a defined allowable size and dimensions) to bring the resonant frequency close to the operating frequency, which causes the entire circuit to be resonant. In some examples, a circuit with an embedded antenna can include additional elements such as capacitive division in order to set the real impedance to be presented to the antenna, in addition to reactance. In example applications involving dipole antenna, the capacitive coupling between the arms can result in inductive impedance beyond the resonant frequency, allowing integration into capacitive circuits such as in RFID tags. In some examples, the circuits may expect a real impedance from the antenna, and matches the real part of the impedance internally, which requires the antenna to be designed to have its resonant frequency close to the operating frequency.

The resonant frequency of the dipole antenna is primarily inversely proportional to the square root of capacitive coupling that occurs among components of the dipole antenna. As such, an increase in capacitive coupling can decrease the resonant frequency, resulting in the increase of the operating wavelength of the antenna without increasing the size of the antenna. Therefore, increasing the capacitive coupling of a dipole antenna allows a size of the dipole antenna to be reduced and can accommodate the decreased operating frequency. To be described in more detail below, an antenna in accordance with the present disclosure can be designed to accommodate applications and systems of low operating frequencies by increasing capacitive coupling that occurs among components of the antenna without increasing the size of the antenna.

FIG. 1 is a diagram illustrating an antenna 100 in one embodiment. The antenna 100 can be a dipole antenna. The antenna 100 includes an antenna feed ("feed") 102, a first dipole arm ("first arm") 110, and a second dipole arm ("second arm") 120. The feed 102 can be a differential antenna feed (e.g., between two terminals) or single-ended (e.g., between one terminal and a reference). The feed 102 can be operable to transmit and receive power to components, objects, devices, systems, circuitry, that are different or separated from the antenna 100. In some examples, a material that forms the first arm 110 and the second arm 120 may be copper. The antenna 100 may be disposed on a layer of substrate that lies on a two-dimensional plane, labeled as x-y plane.

The first arm 110 extends from the feed 102 towards the −x-direction. The first arm 110 can bend or curve towards a center of the x-y plane to form a first partial loop that ends at a point 112. For example, in the illustration in FIG. 1, the first arm 110 bends at a point A and extends in the y-direction, then bends at a point C and extends in the x-direction, then bends at a point E and extends in the −y-direction, then extends towards the −x-direction once again to end at the point 112, thus forming a partial loop. A length of the first arm 110 is measured from the feed 102 to the point 112, along the first arm 110. The point 112 may not contact the feed 102, or may not contact the starting point of the first arm 110 at the feed 102, thus forming a partial loop. Note that the first arm 110 is bent at the point E such that the first arm 110 would not overlap or contact the second arm 120. In an embodiment, the first arm 110 is designed to not form a closed loop.

The second arm 120 extends from the feed 102 towards the x-direction. The second arm 120 can bend or curve towards a center of the x-y plane to form a second partial loop that ends at a point 122. For example, in the illustration in FIG. 1, the second arm 120 bends at a point B and extends in the y-direction, then bends at a point D and extends in the −x-direction, then bends at a point F and extends in the −y-direction to end at the point 122, thus forming a partial loop. A length of the second arm 120 is measured from the feed 102 to the point 122, along the second arm 120. The point 122 may not contact the feed 102, or may not contact the starting point of the second arm 120 at the feed 102, thus forming a partial loop. In an embodiment, the second arm 120 is designed to not form a closed loop.

In an example, a section of the first arm 110 between the feed 102 and the point A ("102-A"), and a section of the second arm between the feed 102 and the point B ("102-B"), can resemble a half-wavelength dipole antenna. Thus, capacitive coupling 104 ("coupling") can occur between the 102-A section of the first arm 110 and the 102-B section of the second arm 120. To increase capacitive coupling of the antenna 100, the first arm 110 and the second arm 120 are extended until additional capacitive coupling 105 ("coupling") occurs between at least a portion of the first arm and a portion of the second arm that are offset from each other. The coupling 105 may be stronger, or have a higher capacitance, than the coupling 104 due to the reduced gap or distance or/and longer portion between the first arm 110 and the second arm 120. For example, the coupling 105 between the C-to-E section of the first arm 110 and the D-to-F section of the second arm 120 is stronger than the coupling 104.

The amount of extensions of the first arm 110 and the second arm 120 can be adjusted to yield different amount of coupling 105. For example, a first configuration may stop the extension of the first arm 110 at point E, and may stop the extension of the second arm 120 at point F. A second configuration (e.g., shown in FIG. 1) may stop the extension of the first arm 110 at the point 112, and may stop the extension of the second arm 120 at the point 122. Thus, the amount of capacitive coupling in the first configuration is less than the capacitive coupling of the second configuration. Further, the first configuration can achieve a better gain than the second configuration because bending of the arms (the first arm 110 or the second arm 120) causes current flowing within the arms to cancel each other (due to the different current flow directions). The radiation efficiency of the antenna can depend on the cancellation of fields from the arms of the antenna—the lower the cancellation, the better the overall efficiency. Thus, the length, the amount of bending, and direction of bending, a shape of the arms, and/or other attributes of the arms, can be adjusted depending on a desired implementation of the antenna 100 and various antenna design parameters and constraints. Further, due to the current flowing within the arms canceling each other due to bending, an increase in the number of loops formed by the first arm 110 and the second arm 120, which increases amount of bending and/or curving of the arms, can penalize the gain of the antenna 100. Thus, it is noted although the first arm 110 and/or the second arm 120 can form more than one loop (instead of partial loops), a number of loops to be formed by the first arm 110 and/or the second arm 120 can be based on various design and/or performance parameters of the antenna 100. For example, a performance requirement can indicate a target gain of the antenna 100, and a number of loops to be formed by the first arm 110 and/or the second arm 120 can be determined based on the target gain. In some examples, the performance requirements can include a physical size requirement of the antenna (e.g., scaled to wave-length, or size and frequency of operation) and an impedance requirement. In some examples, the performance requirements can indicate an optimization goal of maximizing the gain/efficiency of the antenna. In an example embodiment, the first arm 110 and the second arm 120 being partial loops, which results in a total number of loops to be less than two, can cause the antenna 100 to achieve an optimal gain.

In some example embodiments, the first arm 110 (or the first partial loop) and the second arm 120 (or the second partial loop) may be concentric with each other (e.g., share the same center). In some example embodiments, at least a portion of the first arm 110 (or the first partial loop) and at least a portion of the second arm 120 (or the second partial loop) may be parallel (or substantially parallel) with each other. The first arm 110 and the second arm 120 are non-overlapping and do not contact each other. The lack of contact between the first arm 110 and the second arm 120 allows the coupling 104 and 105 to occur.

The feed 102 can be connected to an external component, such as an integrated circuit, through a transmission line. Current may be provided by the transmission line into the feed 102, and the current can flow from the feed 102 to the point 112 through the first arm 110, and can flow from the feed 102 to the point 122 through the second arm 120. The current flowing through the first arm 110 can cause the first arm 110 to produce a first electric field. The current flowing through the second arm 120 can cause the second arm 120 to produce a second electric field. The coupling 104 between the first arm 110 and the second arm 120 may be weaker than the coupling 105 because the electric fields inducing the coupling 105 are parallel (or spaced apart in a substantially parallel manner) and closer to each other and longer portion when compared with the electric fields inducing the coupling 104. Note that the coupling 105 increases as the gap or distance between the parallel sections of the first arm 110 and the second arm 120 decreases.

In the example embodiment illustrated in FIG. 1, the first arm 110 and the second arm 120 have different size or length from each other when being laid on the same plane (e.g., the x-y plane). To be described in more detail below, in another embodiment, the first arm 110 and the second arm 120 can be of different size or can be the same size when being laid on different planes or substrates.

Figure 2B:
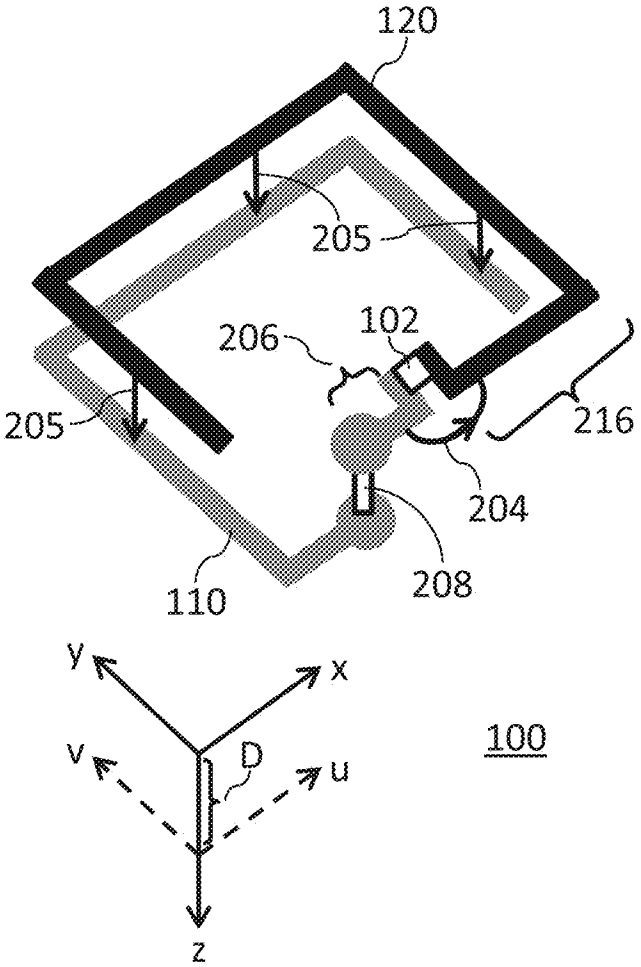
FIG. 2B is a diagram illustrating an angular perspective view of a compact dipole antenna in one embodiment.
Figure 2A:
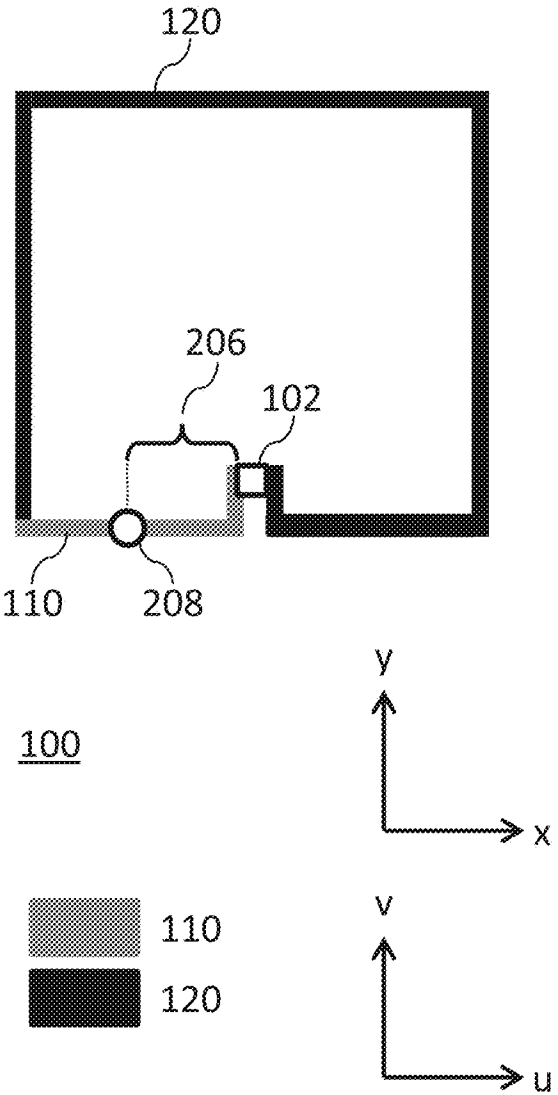
FIG. 2A is a diagram illustrating a top perspective view of a compact dipole antenna in one embodiment.

FIG. 2A is a diagram illustrating a top perspective view of a compact dipole antenna 100 in one embodiment. In an example embodiment illustrated in FIG. 2A, the second arm 120 of the antenna 100 may be disposed on a first (top) layer of substrate that lies on the x-y plane. The first arm 110 of the antenna 100 may be disposed on the first layer of substrate and/or a second (bottom) layer of substrate that lies on a two-dimensional plane, labeled as u-v plane. The substrate that separates the top and bottom layer can be a dielectric material. FIG. 2A illustrates an example embodiment where a portion 206 of the first arm 110 is laid on the x-y plane, and the rest of the first arm 110 are laid on the u-v plane. The portion 206 of the first arm 110 can be connected to the portion of the first arm 110 on the u-v plane using an electrical connection through the first layer of substrate, such as vertical interconnect access ("via") 208.

FIG. 2B is a diagram illustrating an angular perspective view of a compact dipole antenna 100 in one embodiment. In the example embodiment shown in FIG. 2B, the x-y plane's origin and the u-v plane's origin may be separated by a distance D in the z-direction (or vertical direction). Thus, the x-y plane's origin and the u-v plane's origin are both located on the z-axis. Also shown in the example embodiment illustrated in FIG. 2B, coupling 204 can occur between the portion 206 of the first arm 110 and a portion 216 of the second arm 120. A size or length of the vertical interconnect access 208 may be substantially equivalent to D. Further, the portion of the first arm 110 laid on the u-v plane may be vertically separated from the second arm 120 laid on the x-y plane by the distance D. Coupling 205 may occur between the first arm 110 on the u-v plane and the second arm 120 on the x-y plane due to the vertical separation. Note that as the vertical separation or value of D decreases, the strength of the coupling 205 can increase. Further, if either the first arm 110 or the second arm 120 is expanded to be a larger partial loop than the other arm, the lateral separation in the x-direction and/or y-direction, in addition to the vertical separation in the z-direction, can also affect to the coupling 205.

Figure 3B:
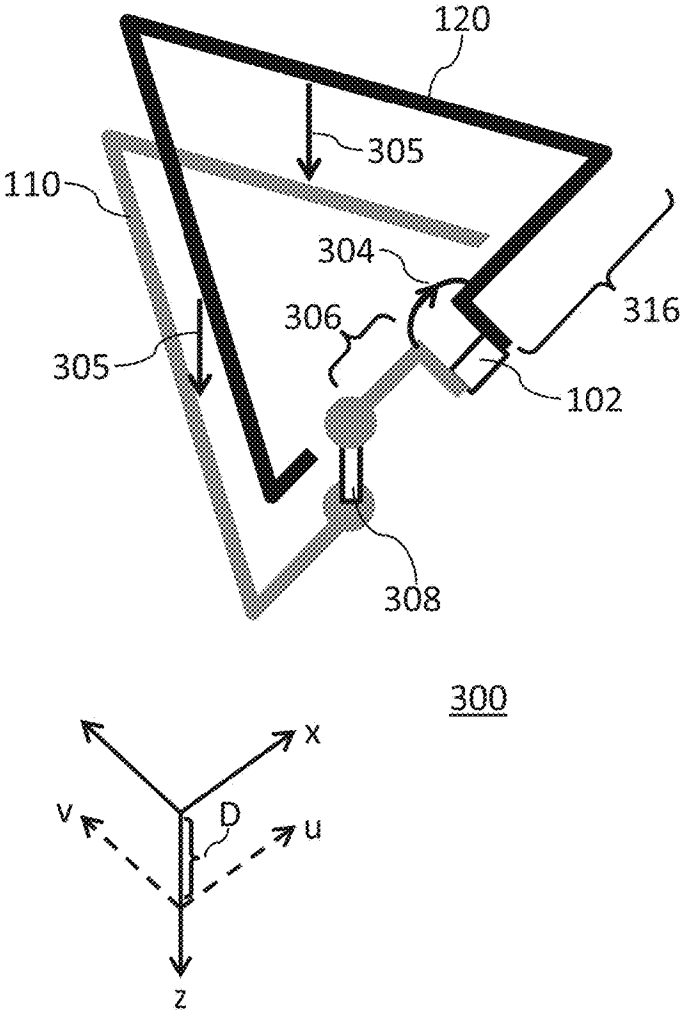
FIG. 3B is a diagram illustrating an angular perspective view of a compact dipole antenna in one embodiment.
Figure 3A:
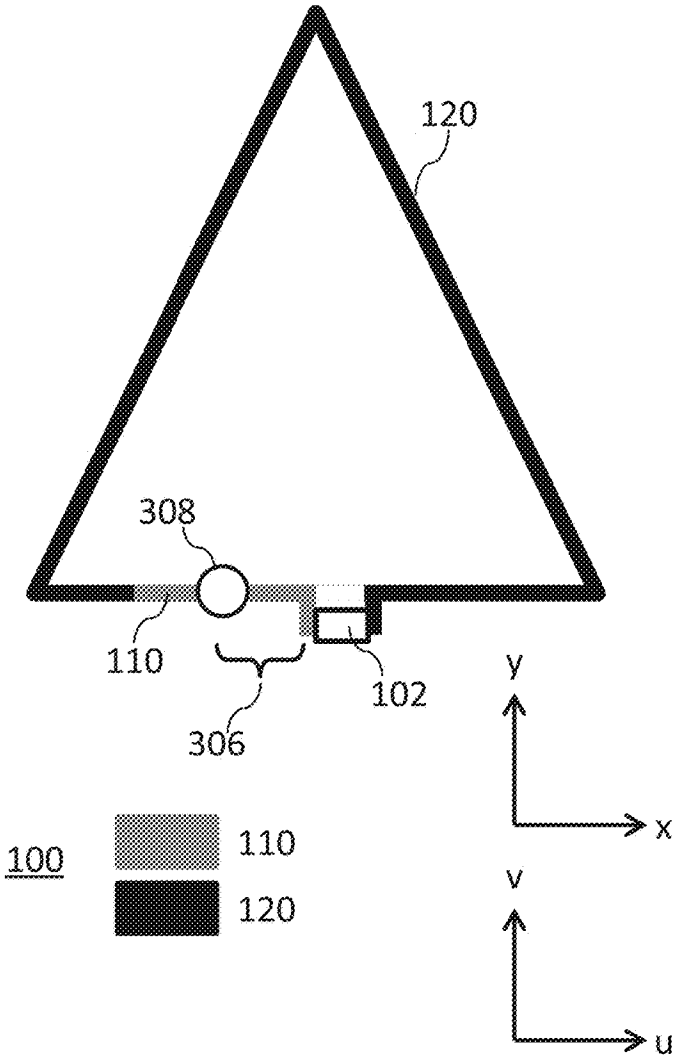
FIG. 3A is a diagram illustrating a top perspective view of a compact dipole antenna in one embodiment.

FIG. 3A is a diagram illustrating a top perspective view of a compact dipole antenna 100 in one embodiment. In an example embodiment illustrated in FIG. 3A, the second arm 120 of the antenna 100 may be disposed on a first (or top) layer of substrate that lies on the x-y plane. The first arm 110 of the antenna 100 may be disposed on the first layer of substrate and/or a second layer of substrate that lies on a two-dimensional plane, labeled as u-v plane. FIG. 3A illustrates an example embodiment where a portion 306 of the first arm 110 is laid on the x-y plane, and the rest of the first arm 110 are laid on the u-v plane. The portion 306 of the first arm 110 can be connected to the portion of the first arm 110 on the u-v plane using an electrical connection through the first layer of substrate, such as vertical interconnect access ("via") 308. In the example embodiment illustrated in FIG. 3A, the first partial loop formed by the first arm 110, and the second partial loop formed by the second arm 120, includes three edges and resembles a triangular shape. The partial loops formed by the first arm 110 and the second arm 120 can be any size and/or shape, and may depend on a desired implementation of the antenna 100, such as constraints corresponding to a physical shape of an object where the antenna would be disposed. For example, the shape of the antenna 100, or the partial loops formed by the first arm 110 and the second arm 120, can be square, rectangular, triangular, octagonal, circular, hexagonal, and/or various shapes with different number of edges and vertices, depending on the design constraints of the antenna 100.

FIG. 3B is a diagram illustrating an angular perspective view of a compact dipole antenna 100 in one embodiment. In the example embodiment shown in FIG. 3B, the x-y plane and the u-v plane may share the same origin and may be separated by a distance D in the z-direction (or vertical direction). Also shown in the example embodiment illustrated in FIG. 3B, coupling 304 can occur between the portion 306 of the first arm 110 and a portion 316 of the second arm 120. A size or length of the vertical interconnect access 308 may be substantially equivalent to D. Further, the portion of the first arm 110 laid on the u-v plane may be vertically separated from the second arm 120 laid on the x-y plane by the distance D. Coupling 305 may occur between the first arm 110 on the u-v plane and the second arm on the x-y plane due to the vertical separation. Note that as the vertical separation or value of D decreases, the strength of the coupling 305 can increase. Further, if either the first arm 110 or the second arm 120 is expanded to be a larger partial loop than the other arm, the lateral separation in the x-direction and/or y-direction, in addition to the vertical separation in the z-direction, can also affect to the coupling 305.

Figure 4:
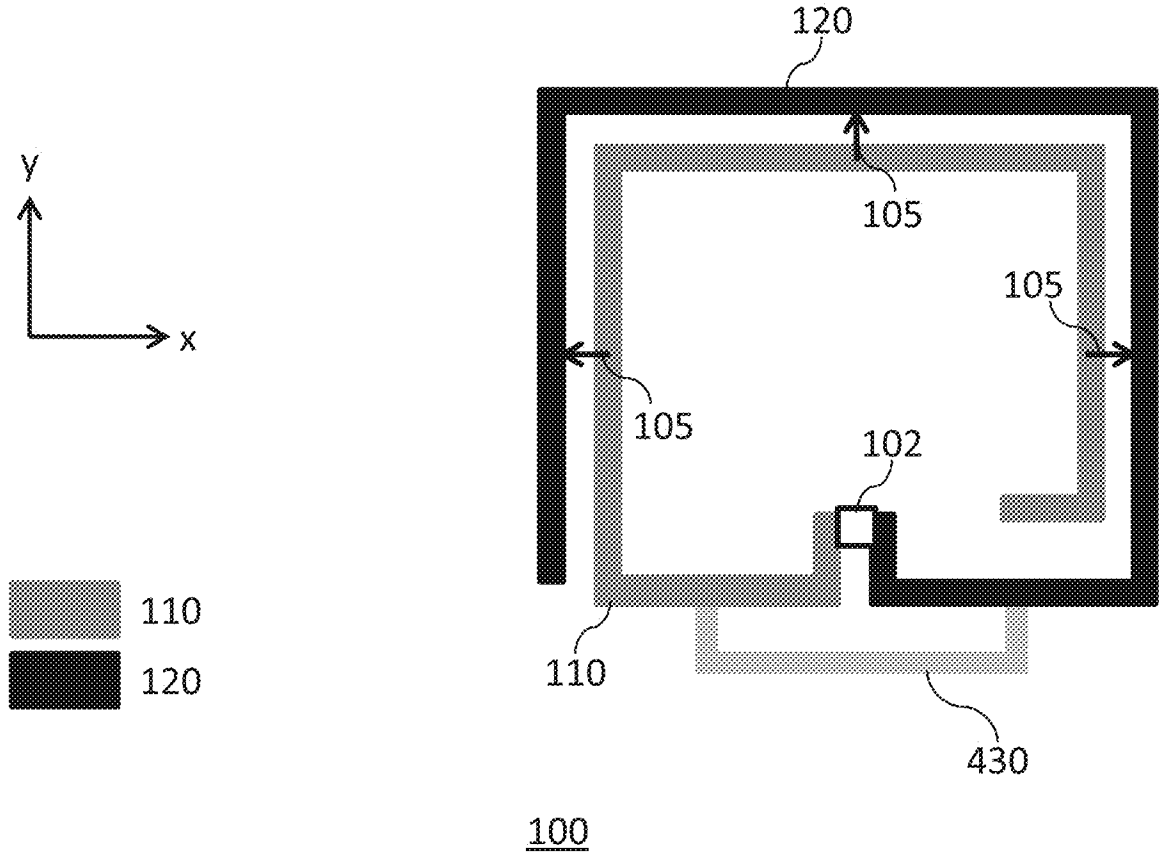
FIG. 4 is a diagram illustrating a compact dipole antenna in one embodiment.

FIG. 4 is a diagram illustrating a compact dipole antenna 100 in one embodiment. An antenna in accordance with the present disclosure provides a flexibility to add components to a compact antenna, such as the antenna 100. For example, a matching circuit 430 can be coupled or connected to the antenna 100. The matching circuit can provide impedance matching for all frequency bands produced by the antenna 100. The effects of the matching circuit 430 on the antenna 100 can be based on, for example, 1) a dimension, such as a size or length of the first arm 110 and the second arm 120, 2) the gap or distance between the first arm 110 and the second arm 120, 3) a dimension of the matching circuit 430, and/or other factors.

Figure 5:
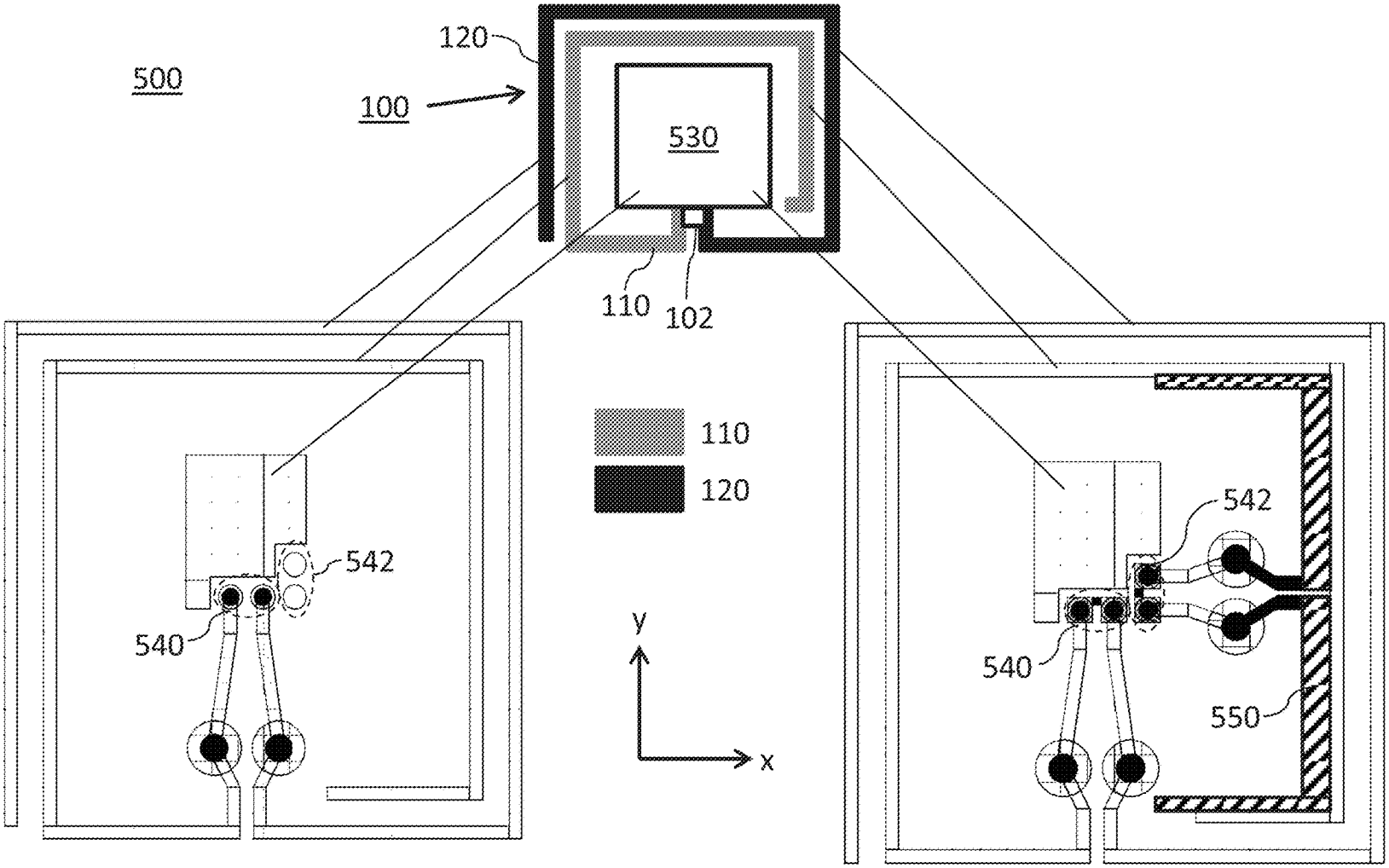
FIG. 5 is a diagram illustrating an example system that includes a compact dipole antenna in one embodiment.

FIG. 5 is a diagram illustrating an example system 500 that includes a compact dipole antenna in one embodiment. The system 500 can be a part of a computer device, a wireless transmission system, or a system on a chip that may be a part of a wireless transmission device. The system 500 can include an integrated circuit 530, where the integrated circuit 530 may be a radio frequency integrated circuit (RFIC). The integrated circuit 530 may be connected or coupled to the antenna 100 via the feed 102. In some examples, the antenna 100 and the integrated circuit 530 collectively form an integrated circuit (e.g., the circuitry forming the antenna 100 can be a part of the integrated circuit 530). In the example shown in FIG. 5, the integrated circuit 530 includes two ports, a port 540 and a port 542, where the ports 540, 542 can be differential ports and collectively form the feed 102. The antenna 100 can be connected to the integrated circuit 530 by connecting the feed 102 to the port 540. In an example configuration, the antenna 100 can be disposed or patterned on the same layer as the integrated circuit 530, such that the inner dipole arm (the first arm 110) encompasses the integrated circuit 530. By having the integrated circuit 530 and the antenna 100 disposed on the same layer of substrate, the system 500 can be designed to have a relatively small thickness.

In another example configuration, the first arm 110 and the second arm 120 can be disposed on two different layers of substrate, and the integrated circuit 530 can be disposed on one of the two layers of substrate. Such a configuration allows the first arm 110 and the second arm 120 to be substantially on top of one another, allows the arm forming the inner partial loop (e.g., first arm 110) to have a greater length (or a larger partial loop), and provides better symmetry between the two arms. Such a configuration is similar to the configuration of the antenna 100 shown in FIGS. 2A-2B and 3A-3B above. In some examples, the antenna 100 can be designed and produced depending on minimum spacing rules of the technology being used to manufacture the antenna 100 and the layer spacing (in the z-direction) between the two arms on different layers. The different configurations of forming the two arms on the same layer and forming the two arms on separate layers can provide different amounts of coupling. In an example embodiment, a selection of the configuration to use one or two layers to form the antenna 100 can be based on a function of cost (e.g., more layers may incur more cost but may provide more flexibility on spacing between the arms) and various performance requirements of the antenna 100.

In the example shown in FIG. 5, since the integrated circuit 530 has two differential ports (540, 542), two antennas can be connected to the integrated circuit 530. For example, another antenna 550 can be connected to the integrated circuit 530 through the port 542. The antenna 550 can be disposed on a different layer of substrate from the first arm 110 and the second arm 120 of the antenna 100. The antenna 550 can be disposed on a different layer of substrate from the integrated circuit 530 and connected to the port 542 through a vertical interconnect access. As such, a wireless transmission system or device can be formed to have different antennas of different sizes, operating frequencies, bands, wavelengths, and/or other antenna attributes.

Figure 6:
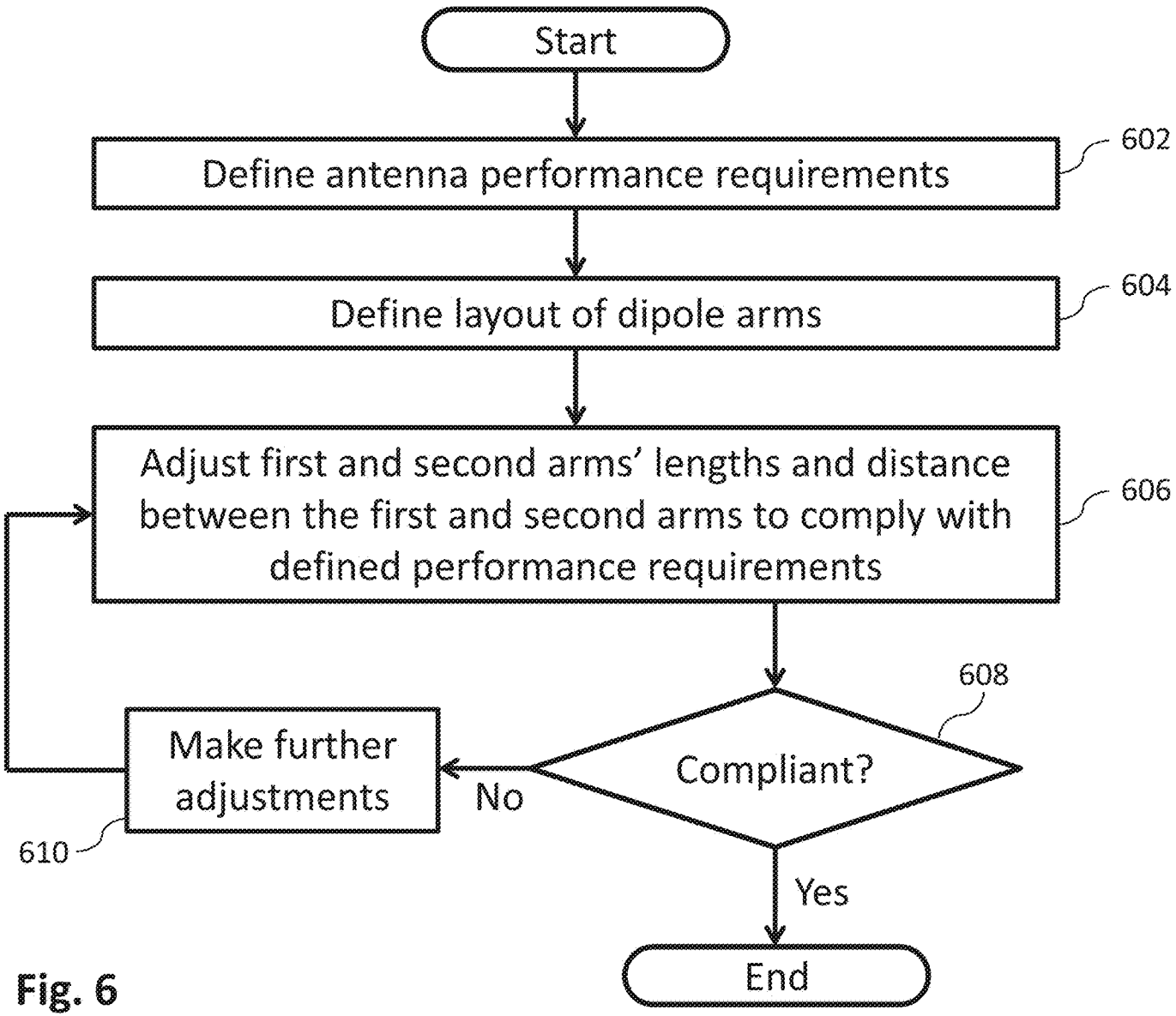
FIG. 6 is a flow diagram illustrating a process that can be implemented to form a compact dipole antenna in one embodiment.

FIG. 6 is a flow diagram illustrating a process that can be implemented to form a compact dipole antenna in one embodiment. An example process may include one or more operations, actions, or functions as illustrated by one or more of blocks 602, 604, 606, 608, and/or 610. Although illustrated as discrete blocks, various blocks may be divided into additional blocks, combined into fewer blocks, eliminated, or performed in parallel, depending on the desired implementation.

A process to design and form an antenna (e.g., antenna 100 shown in FIGS. 1-5) in accordance with the present disclosure begins at block 602. At block 602, a set of antenna performance requirements can be obtained or defined. For example, a manufacturer of the antenna can receive a set of performance requirements from a customer who requested to manufacture the antenna. In another example, a designer or researcher of the antenna can define the set of performance requirements and provide the set of performance requirements to the manufacturer of the antenna. The set of antenna performance requirements may include a maximum antenna size, a maximum area spanned by the antenna, the antenna's operating frequency, the antenna's impedance, the antenna's gain, a minimum metal strip (dipole arm) width and/or length, minimum spacing (or gap, or distance) between the metal strips (or dipole arms), and/or other antenna performance requirements. One or more performance requirements among the set of performance requirements may be dependent on one or more other performance requirements. For example, the size (e.g., length and/or width) of the antenna's arms can be dependent on the required gain and operating frequency of the antenna. In another example, if a region of a device (e.g., RFID reader or RFID tag) to install the antenna has a width W and a length L, then the antenna dipole arms' size can be restricted to fit the antenna within the boundaries defined by W and L. In another example, the outer dipole arm (e.g., second arm 120 in FIG. 1) can be patterned based on W and L, and the inner dipole arm (e.g., first arm 110 in FIG. 1) can be patterned to fit within the boundaries defined by the patterned outer dipole arm and in accordance with the defined spacing between the arms.

The process can continue from block 602 to block 604. At block 604, a layout of the antenna's dipole arms can be defined. For example, the antenna's dipole arms can be etched or patterned on the same layer of substrate if an integrated circuit to be disposed within the inner dipole arm's partial loop can fit within the boundaries defined by the inner partial loop. In another example, if the integrated circuit is relatively large, then the antenna can be designed to have dipole arms on different layers of substrate such that the integrated circuit can fit within regions define by one of the dipole arms. In another example, a shape of the antenna, such as the partial loops formed by the dipole arms, is dependent on a device that will include the antenna. For example, if a region of a RFID reader or RFID tag to embed the antenna is of a circular shape, the antenna's layout can have a circular shape with dipole arms curving to form circular partial loops.

The process can continue from block 604 to block 606. At block 606, the length of the antenna's arms can be adjusted until particular conditions are met. The length of the antenna's arms can be increased or decrease iteratively, through trial and error, and/or through an optimization process in accordance with relationships between the dipole arm lengths and antenna properties such as resonant frequency, operating frequency, impedance, and/or other antenna properties. For example, the length of the dipole arms can be increased or the gap between the dipole arms can be decreased until to reduce a resonant frequency of the antenna, and such adjustments can continue until a difference between the resonant frequency and the operating frequency is within a threshold (the threshold can be based on a desired implementation of the antenna). In another example, the size of the dipole arms and/or the gap between the dipole arms can be adjusted until the antenna's impedance is compliant with a defined value (the defined value can be based on a desired implementation of the antenna). The adjustment of the gap between the arms can include, for example, adjusting the distance between the arms in the x-direction and/or the y-direction (shown in FIG. 1) in a configuration where the arms are disposed on the same layer of substrate, and adjusting the distance between the arms in the x-direction, y-direction, and/or the z-direction (shown in FIG. 2) in a configuration where the arms are disposed on different layers of substrate. Further, the trace width (e.g., width of the metal strips forming the arms) and thickness of the metal strips can affect the coupling between the arms differently between the one-layer configuration and the two-layer configuration. For example, the coupling varies based on the trace width at a faster rate in the two-layer configuration when compared to the one-layer configuration. Similarly, the coupling varies based on the metal strip thickness at a faster rate in the one-layer configuration when compared to the two-layer configuration.

The process can continue from block 606 to block 608. At block 608, the antenna can undergo one or more tests to determine whether dimensions (e.g., size and layout) of the dipole arms of the antenna, and performances such as gain, efficiency, impedance, bandwidth, are compliant with the set of performance requirements defined from block 602. For example, a prototype of the antenna can be produced and a particular amount of voltage can be applied to the prototype to measure antenna properties such as resonant frequency, operating frequency, impedance, gain, and/or other antenna properties. In response to the antenna dipole arms being compliant, the design and/or formation of the antenna is completed and the antenna can be produced according to the compliant dimensions, sizes, and layout. In response to the antenna dipole arms not being compliant, the process can continue from block 608 to block 610. At block 610, it is determined that various attributes of the antenna's dipole arms may need further adjustments. For example, a position of the feed (e.g., feed 102 in FIG. 1) can be adjusted, such as in the x-direction or −x-direction shown in, for example, FIG. 1. Thus, the process can loop from block 610 back to block 606, where adjustments to the length, the width of the metal strips, the gap between the dipole arms, a position of the antenna feed between the two dipole arms, and/or other attributes of the antenna can be made. The adjusted antenna can undergo the various tests at block 608 to determine whether the adjusted antenna is compliant with the set of performance requirements.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a wave-guide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements, if any, in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An antenna comprising:

a feed operable to transmit and receive power;

a first arm disposed on a first layer of substrate that lies on a first two-dimensional plane, the first arm being extended from the feed towards a first direction to form a first partial loop, the first arm being bent towards a center of the first partial loop at a first bending point and at a second bending point, and the first arm extends beyond the second bending point; and a second arm disposed on a second layer of substrate that lies on a second two-dimensional plane different from the first two-dimensional plane, the second arm being extended from the feed towards a second direction to form a second partial loop, wherein the second direction is different from the first direction, the second arm being bent towards a center of the second partial loop at a third bending point and at a fourth bending point, and the second arm extends beyond the fourth bending point, and a portion of the first arm extended beyond the second bending point and a portion of the second arm extended beyond the fourth bending point are parallel to one another, wherein the first arm is partitioned into a first portion and a second portion, the first portion of the first arm including the first bending point is disposed on the first layer of substrate, the second portion of the first arm is disposed on the second layer of substrate, and the feed is disposed on the second layer of substrate.

2. The antenna of claim 1, wherein the first arm and the second arm are concentric with each other.

3. The antenna of claim 1, wherein the parallel portions of the first arm and the second arm are offset by a distance, and coupling between the first arm and the second arm is based on the distance.

4. The antenna of claim 1, wherein the first portion of the first arm is connected to the second portion of the first arm by an electrical connection through the first layer of substrate.

5. The antenna of claim 1, further comprising a circuit operable to perform impedance matching, wherein the circuit is coupled to the first arm and the second arm.

6. The antenna of claim 1, wherein the first two-dimensional plane is below the second two-dimensional plane.

* * * * *